United States Patent [19]

Blatnik et al.

[11] 4,142,663

[45] Mar. 6, 1979

[54] APPARATUS AND METHOD FOR MAKING PERFORATED TUBE

[75] Inventors: George A. Blatnik, Glendale; John W. Kosareff, Los Angeles, both of Calif.

[73] Assignee: Kaiser Steel Corporation, Oakland, Calif.

[21] Appl. No.: 791,971

[22] Filed: Apr. 28, 1977

[51] Int. Cl.[2] ..... B23K 31/06; B21C 37/15

[52] U.S. Cl. ..... 228/147; 228/174; 228/13; 228/17; 228/17.5; 29/163.5 R; 72/186; 83/345

[58] Field of Search ..... 228/146–147, 228/151, 170, 174, 17, 17.5, 18, 5.1, 13, 183; 83/121–122, 345, 660, 669, 670; 29/163.5 R; 72/186, 187, 52; 181/296, 247

[56] References Cited

U.S. PATENT DOCUMENTS

| | | | |
|---|---|---|---|
| 1,053,614 | 2/1913 | Iayne | 228/147 X |
| 1,410,018 | 3/1922 | Kiracofe | 83/122 |
| 2,781,095 | 2/1957 | Spinner | 83/345 X |
| 3,142,216 | 7/1964 | Rupnow | 83/345 X |
| 3,446,049 | 5/1969 | Greis | 83/345 X |
| 3,461,531 | 8/1969 | De Gain | 228/151 X |
| 3,524,245 | 8/1970 | Searing | 228/151 X |
| 3,682,028 | 8/1972 | Clayton | 83/345 X |
| 4,068,366 | 1/1978 | Hillesheim | 72/186 |

*Primary Examiner*—C.W. Lanham
*Assistant Examiner*—K. J. Ramsey
*Attorney, Agent, or Firm*—Naylor, Neal & Uilkema

[57] ABSTRACT

A rolled sheet metal tube having perforations therein with integrally formed associated protrusions. The protrusions alter the direction of the flow of fluid passing through the tube and ideally suit the tube for employment in mufflers for internal combustion engines. A tube mill incorporating a roll press as its first pass to perforate sheet metal strip as it is fed to the mill. The roll press comprises a die roll having circumferentially continuous slots extending therearound and a punch roll having spaced punches for entry into the slots of the die roll as sheet metal strip is drawn between the rolls. The punches form perforations in the strip as the strip is drawn between the rolls and in certain embodiments the slots and/or punches are configured to form protrusions in the strip simultaneously with the formation of the perforations. In the embodiments where protrusions are formed, the strip engaging elements of the mill are preferably configured to accommodate the protrusions as the strip is processed to the desired tubular configuration. Ejector fingers extend into the continuous grooves in the die roll to eject punched out strip material from the grooves.

18 Claims, 12 Drawing Figures

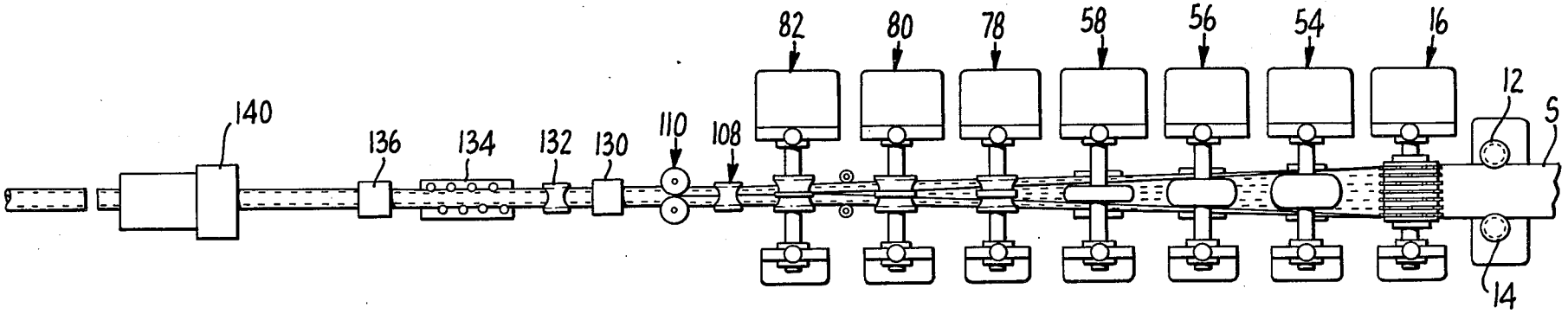
FIG. 1.
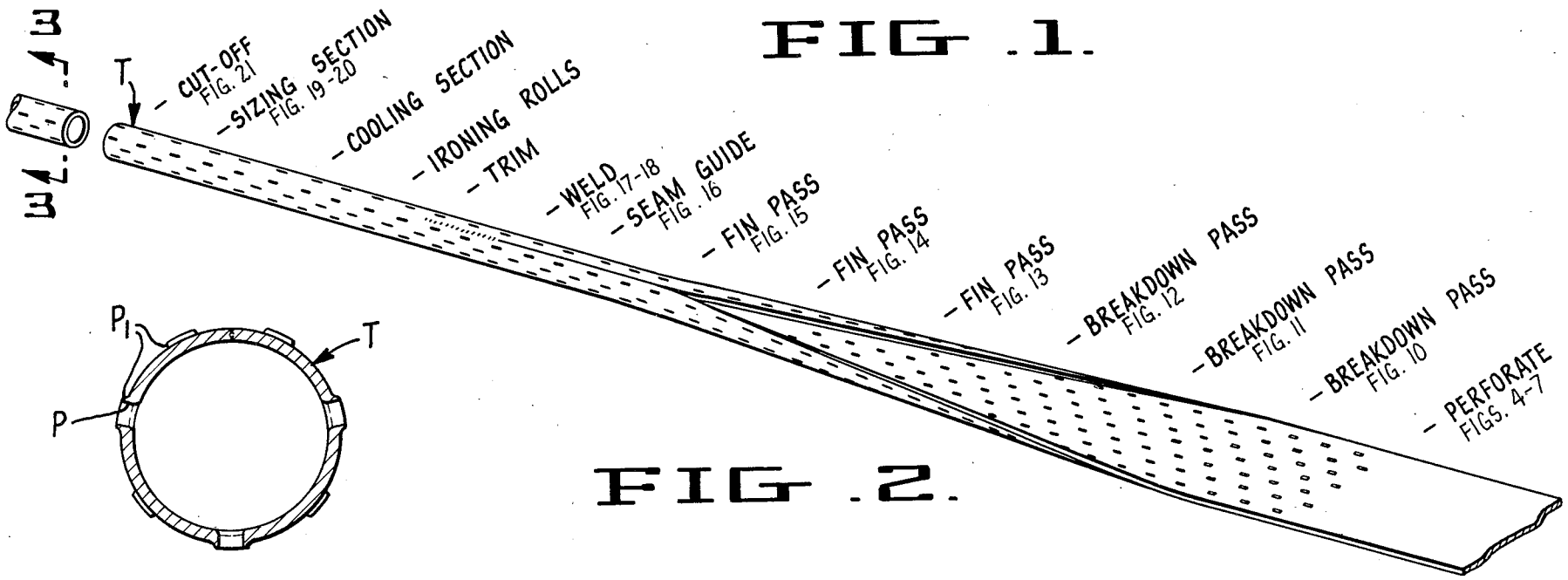
FIG. 2.
FIG. 3.

APPARATUS AND METHOD FOR MAKING PERFORATED TUBE

BACKGROUND OF THE INVENTION

The present invention relates to a tube mill for forming tubular stock from flat roll stock, more particularly, to a tube mill which forms a perforated tube from flat roll stock fed to the mill in an imperforate condition. It is also concerned with a particular perforated tube configuration wherein protrusions are formed in association with the perforations to alter the path of fluid flowing through the tube.

The flat roll stock supplied to tube mills of the type with which the present invention is concerned is typically supplied to the mill in a coil. In processing, the stock is drawn from the coil directly into the mill. Prior art techniques wherein such stock was used for forming perforated tubes have relied upon a discontinuous operation wherein the strip is first uncoiled and passed through a punch press, then recoiled and, ultimately, again uncoiled as it is drawn through the tube mill.

The prior art also discloses the use of roll presses to perforate sheet stock which is, ultimately, formed into a tube. U.S. Pat. Nos. 1,053,614 and 1,849,188 disclose such roll presses. These patents do not, however, suggest the concept of incorporating a roll press into a tube mill so as to direct the output of the press directly into the mill, without the necessity of recoiling the flat roll stock. The die and press rolls of the roll presses disclosed in these patents incorporate complementally interengagable elements which necessitate synchronized drive of the rolls.

U.S. Pat. No. 3,858,785 is of interest with respect to the present invention in that it discloses a tube mill wherein strip patterning rolls are disposed at the lead end of the mill to pattern the surface of flat roll stock fed through the mill. This patent does not, however, suggest the incorporation of a perforating roll press into a tube mill, nor the design of a tube mill to accommodate perforated stock processed by such a mill.

The prior art also suggests that mufflers for internal combustion engines may be provided with tubular core elements having perforations therein with protruding edges. U.S. Pat. Nos. 3,276,108 and 3,286,786 are examples of such art.

SUMMARY OF THE INVENTION

In its broadest aspects, the mill of the present invention is concerned with the direct forming of a perforated tube from a strip of imperforate flat roll stock, without the necessity of perforating the flat stock in advance of its entry into the mill.

The mill incorporates an improved roll press having opposed mating rolls mounted in parallel closely spaced relationship to one another and driven for rotation about the respective longitudinal axes thereof to draw a strip therebetween. The press forms the first pass of the mill and the respective rolls have mating punches and circumferentially continuous annular slots whereby, on drawing of a strip of flat stock between the rolls, the punches enter the slots to perforate the stock.

In its more specific aspects, the invention is concerned with such a tube mill wherein the roll press is configured to form protruding edges and/or loops on the perforations formed in the flat roll stock and wherein the tube-forming elements of the mill accommodate such protrusions without substantial flattening.

The invention is also concerned with the particular configuration of the tube so formed.

A principal object of the invention is to provide a tube mill wherein perforated tube may be formed from flat roll stock with optimum efficiency and with a minimum of handling.

Another and related object of the invention is to provide a tube mill wherein perforated tube may be formed from flat roll stock and protruding characteristics may be imparted to the tube within the mill.

Still another object of the invention is to provide a tube mill capable of forming perforated tube having flow characteristics ideally suiting the tube for employment in mufflers of the type used for internal combustion engines.

Yet another object of the invention is to provide a roll press for perforating flat roll stock which does not require that the punch and guide rolls be driven in synchronization.

A further object of the invention is to provide a roll press capable of perforating flat roll stock and forming projecting edge or loop portions on the perforations which may extend to either side of the plane of the stock.

The foregoing and other objects will become more apparent when viewed in light of the accompanying drawings and following detailed description.

BRIEF DESCRIPTION OF THE DRAWINGS

FIG. 1 is a plan view of a preferred embodiment of a tube mill constructed according to the present invention;

FIG. 2 is a diagrammatic perspective view of a strip of roll stock, as it travels through the mill;

FIG. 3 is a cross-sectional view, taken on the plane designated by Line 3—3 of FIG. 2, illustrating the configuration of the tube produced by one exemplary embodiment of the invention;

DESCRIPTION OF THE ILLUSTRATED EMBODIMENTS

Figure 4:
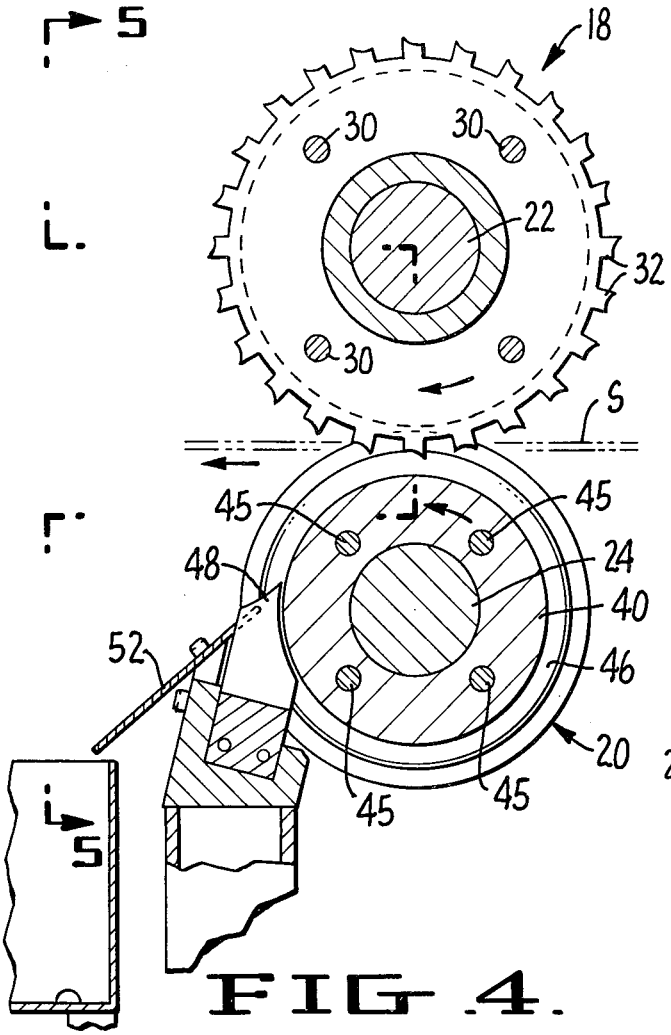
FIG. 4 is a cross-sectional elevational view, with parts thereof broken away, illustrating one embodiment of the roll press of the invention.

Referring more particularly to the drawings, the reference character S indicates a strip of sheet metal, such as cold rolled steel, which is supplied from a coil (not shown). The strip S is guided into the input end of the tube mill by a pair of guide rollers 12 and 14 which define a pass line along which the strip travels. A roll press, generally indicated at 16, is disposed in the pass line in adjacent spaced relationship to the guide rollers and comprises the first pass of the mill.

Roll press 16 is a principal component of the apparatus of the present invention and also performs a key function (i.e., that of perforating) of the method of the invention. The basic structure of the roll press may best be seen from FIGS. 4 and 5 wherein a cross-sectional elevational view of one embodiment of the press is illustrated. As seen in these figures, the press comprises a punch roll 18 and a die roll 20. The punch roll 18 is mounted on and for rotation with a support shaft 22 and the die roll is mounted on and for rotation with a support shaft 24. The shafts 22 and 24 are disposed in spaced parallel relationship to one another and define the respective longitudinal axes of the rolls. The shafts are driven in the directions indicated by the arrow lines in FIG. 4 and are so spaced that the rolls 18 and 20 grip the strip of metal S and draw it between the rolls. As shown in FIG. 4, the strip would move from right to left.

Figure 6:
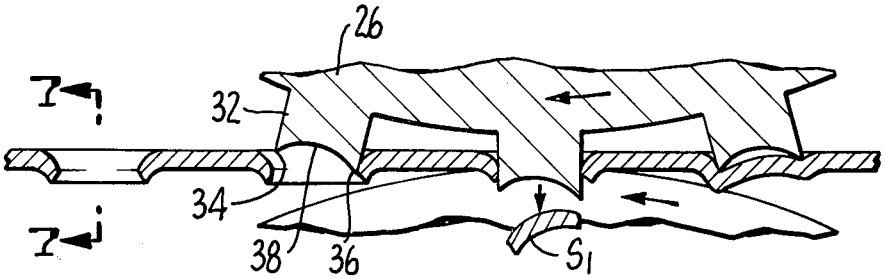
FIG. 6 is an enlarged cross-sectional elevational view of the punch and die rolls of the embodiment of the invention shown in FIG. 4, illustrating a strip of flat roll stock being drawn between the rolls.
Figure 7:
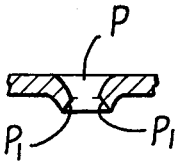
FIG. 7 is a cross-sectional view taken on the plane designated by Line 7—7 of FIG. 6.

The punch roll 18 is comprised of a plurality of annular punch discs 26 sandwiched between holding rings 28 mounted on the shaft 22. Through-bolts 30 (See FIG. 4) secure the discs and rings in assembled condition. Each disc 26 has a plurality of punches 32 extending generally radially therefrom in angularly spaced relationship to one another. The detailed construction of the punches is illustrated in FIG. 6 wherein it can be seen that each punch has a leading cutting edge 34, a trailing cutting edge 36 and generally concave lateral cutting edges 38. The trailing cutting edge 36 is the longest of the cutting edges, as measured radially from the center of the punch roll, and is so proportioned that it forms the first cut through the strip being perforated. The leading cutting edge 34 is the second longest of the cutting edges, as measured radially from the center of the punch roll 18, and is so proportioned that it forms a second cut through the strip being perforated. As measured radially from the center of the punch roll 18, the lateral edges 38 are shorter than the edges 34 and 36 and, thus, the lateral edges cut through the strip S after the edges 34 and 36 have completed their cuts. As a result of the relative proportions of the various cutting edges, end cuts are first formed by the edges 34 and 36 and lateral cuts are, subsequently, simultaneously cut by the edges 38. This cutting sequence has the advantage that the segment of metal, designated $S_1$ (See FIG. 6), being removed during the perforation operation is secured to the strip on oppositely disposed sides of the segment until the final lateral cuts are complete. As a result, the segment is cleanly sheared from the strip and the possibility that the segment may bend down from one side of the perforation being formed, without being removed, is substantially eliminated.

Figure 5:
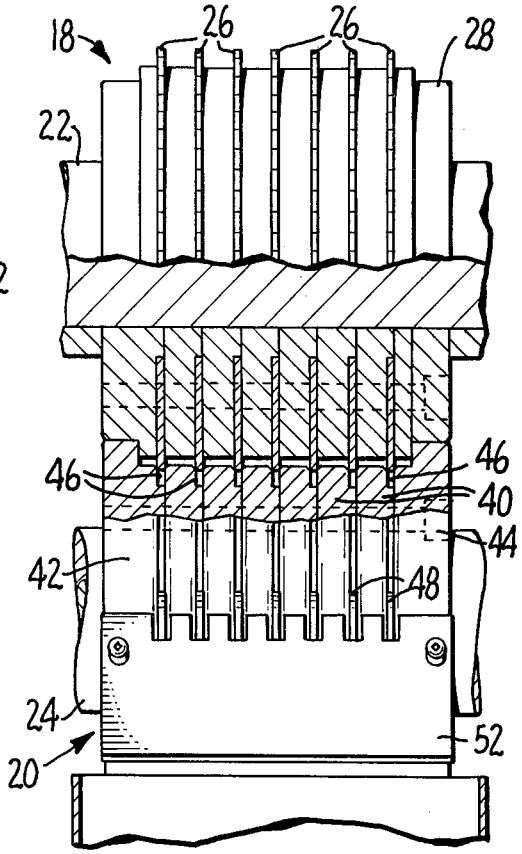
FIG. 5 is an elevational view taken on the plane designated by Line 5—5 of FIG. 4.

The die roll 20 is comprised of a plurality of rings 40 concentrically received on the shaft 24 in side-by-side relationship to one another. The rings 40 are held in place by end plates 42 and 44 secured together by through-bolt 45. The end plate 42 and each of the rings 40 has a circumferentially continuous groove 46 extending therearound. These grooves are positioned so as to be aligned with the respective punch discs 26 and proportioned for close slidable receipt of the punches 32. In the embodiment of FIG. 5, as may best be seen from FIG. 22, the opposite outermost edges of the grooves 46 are flared, as depicted at $46_1$. As a result of the flared edges, the strip being perforated is deformed so as to be protruded outwardly on the lateral edges of the perforation, designated P, being formed. The latter characteristic may be seen from FIGS. 5 and 22, wherein the protruding edges are designated $P_1$.

FIGS. 4 and 5 also illustrate a mechanism for ejecting the cut segments of metal $S_1$ from the grooves 46. This mechanism comprises fingers 48 extending into the grooves 46 and conformed so as to fit closely within the respective grooves without contacting the surfaces thereof. The fingers are fixed against rotation with the roll 20 and are held in place by a mounting block 50. The block 50 also carries a wiper plate 52 mounted so as to pass closely over the outermost surfaces of the rings 40 and end plates 42 and 44.

Spaced along the pass line, from the roll press 16, are three sequential breakdown roll stands, indicated, respectively, at 54, 56 and 58. The breakdown roll stands start with the flat strip S and gradually deform the strip preliminary to forming the ultimate tube.

Figure 10:
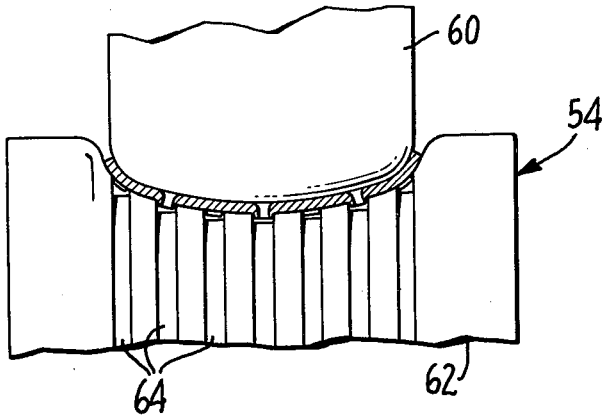
FIG. 10 is a cross-sectional view, transverse of the direction of travel of the strip, showing the deforming rolls in the roll stand for the first breakdown pass of the mill.
Figure 11:
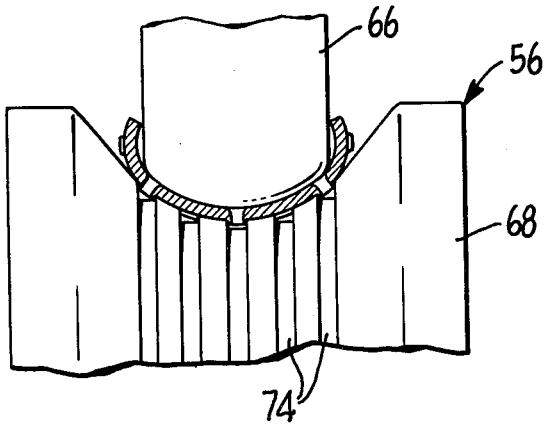
FIGS. 11, 12, 13, 14 and 15 are views similar to FIG. 10, showing the progressive deforming rolls of the mill at sequential roll stands.
Figure 12:
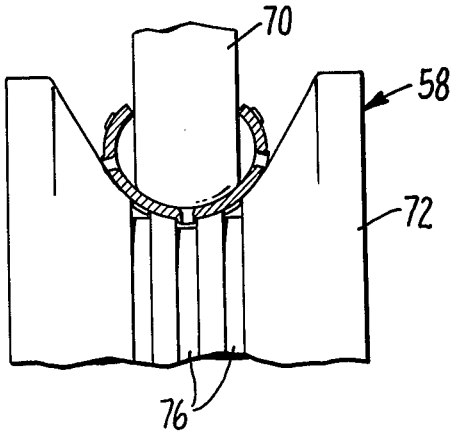

Referring to FIG. 10, it will be seen that the initial breakdown roll stand 54 has a pair of complemental forming rolls 60 and 62 and that the roll 62 is formed with annular grooves 64 to accommodate the protruding edges $P_1$ without substantially flattening the edges. The detailed construction of the roll stands 56 and 58 may be seen from FIGS. 11 and 12 wherein the stand 56 is shown as being comprised of forming rolls 66 and 68 and the stand 58 is shown as being comprised of forming rolls 70 and 72. The rolls 68 and 72, respectively, are provided with annular grooves 74 and 76 to accommodate the protruding edges $P_1$ of the strip, without substantially flattening the edges.

Figure 13:
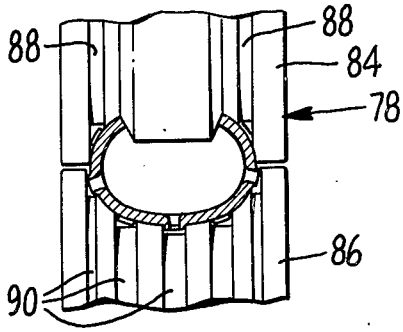
Figure 14:
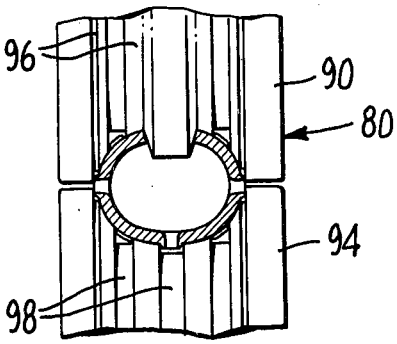
Figure 15:
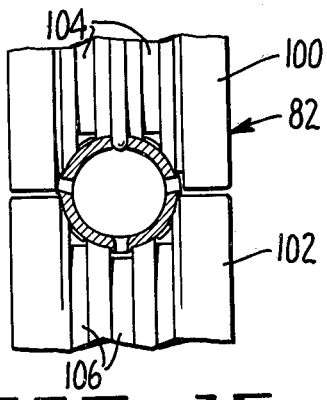

Spaced along the pass line from the breakdown roll stands 54, 56 and 58 are fin roll stands 78, 80 and 82, respectively. The fin roll stands complete the deformation of the strip $S_1$ into a tubular form. The detailed configuration of the rolls and the roll stands 78, 80 and 82 is illustrated in FIGS. 13, 14 and 15. From these figures, it may be seen that the stand 78 comprises forming rolls 84 and 86 having grooves 88 and 90, respectively, formed therein to accommodate the protruding edges $P_1$ without substantial flattening; that the stand 80 comprises forming rolls 92 and 94 having grooves 96 and 98, respectively, formed therein to accommodate the protruding edges $P_1$ without substantial flattening; and, that the stand 82 comprises forming rolls 100 and 102 having grooves 104 and 106, respectively, formed therein to accommodate the protruding edges $P_1$ without substantial flattening.

Figure 16:
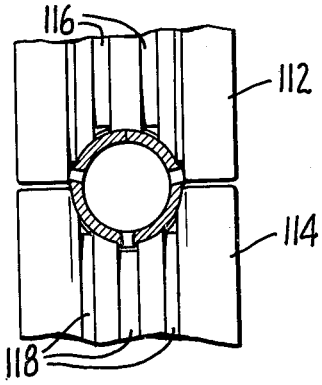
FIG. 16 is a cross-sectional view, transverse of the direction of travel of the strip, showing the seam guide of the mill, with a tube engaged therein and the seam edges of the tube in confronting non-welded relationship.

A seam guide roll stand 108 is spaced along the pass line from the fin roll stand 82 (See FIG. 1). The stand 108 is provided to orientate the seam of the tube being formed for direction into the welder, designated 110. The stand 108 comprises a pair of rolls 112 and 114 (See FIG. 16) adapted to securely embrace the partially formed tube exiting from the stand 82. Grooves 116 and 118 are formed in the respective rolls 112 and 114 to accommodate the protruding edges $P_1$ in order to prevent these edges from being significantly flattened as the tube passes through the stand 108.

Figure 17:
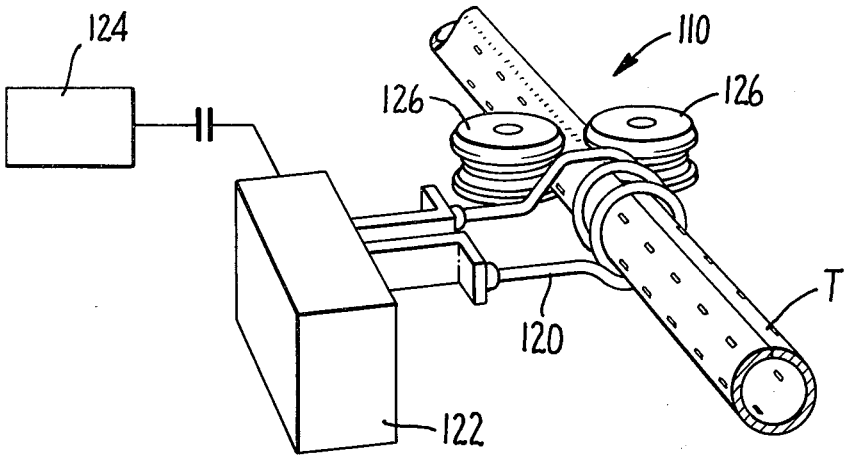
FIG. 17 is a perspective view of the seam welder of the mill.
Figure 18:
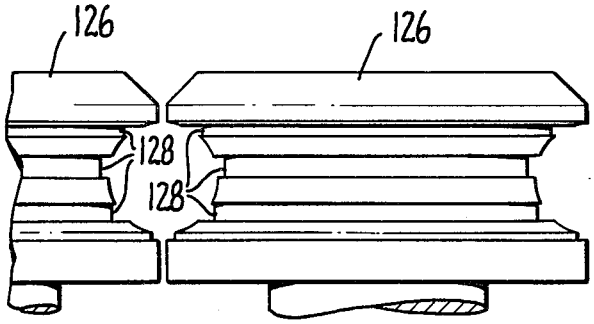
FIG. 18 is an enlarged elevational view, with parts thereof broken away, illustrating the holding rollers of the FIG. 17 welders.

With the strip in the condition provided by the seam guide roll stand 108 (i.e., with the seam edges in confronting relationship to one another), the seam is welded through means of the welder 110. The welder 110 is of the medium-frequency induction type and is illustrated in detail in FIGS. 17 and 18. It comprises: an induction hearing coil 120 through which the tube, designated T, is passed; a capacitor rack 122 for powering the coil 120; an AC power source 124, such as a 10 kHz motor generator; and, side pressure rolls 126 to compress the seam edges together so that a fluid-tight welded seam is achieved on cooling of the welded joint. The side pressure rolls 126 are shown in detail in FIG. 18 wherein it can be seen that each roll is provided with grooves 128 to accommodate the protruding edges $P_1$ so that these edges are not subjected to substantial flattening as the tube passes between the rolls.

A trimmer 130 (See FIG. 1) is spaced along the pass line from the welder 110 and functions to trim off any protruding metal adjacent the seam formed by the welder. Ironing rolls 132 are disposed in the pass line downstream and adjacent to the trimmer 130 to restore the welded tubing T to a cylindric shape, should it have been distorted by the welders or the trimmers. The ironing rolls have a configuration similar to the rolls 126 and are grooved to accommodate the protruding edges $P_1$ so that these edges are not subjected to substantial flattening in the ironing rolls.

Although the welder has been described as a medium-frequency induction welder, it should be understood that other types of welders might be employed. Suitable alternatives might be a high-frequency contact welder or a low-frequency resistance welder.

Figure 19:
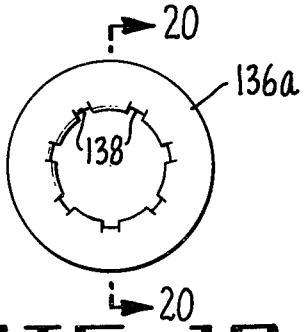
FIG. 19 is an end view of a sizing shoe used in the final sizing section of the mill.
Figure 20:
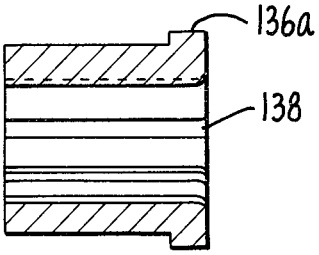
FIG. 20 is a cross-sectional view of the FIG. 19 sizing shoe, taken on the plane designated by Line 20—20 of FIG. 19.

After the welded tubing exits from the ironing rolls 132, it is passed through a cooling station 134 and from this station, the tube is transported through a sizing station 136. In the embodiment illustrated, the sizing station comprises a straightening shoe **136*a* (See FIGS. 19 and 20). The shoe is of relatively conventional construction with the exception that it is provided with internal grooves 138** to accommodate the protruding edges $P_1$ so that these edges are not substantially flattened as the tube passes through the shoe.

Figure 21:
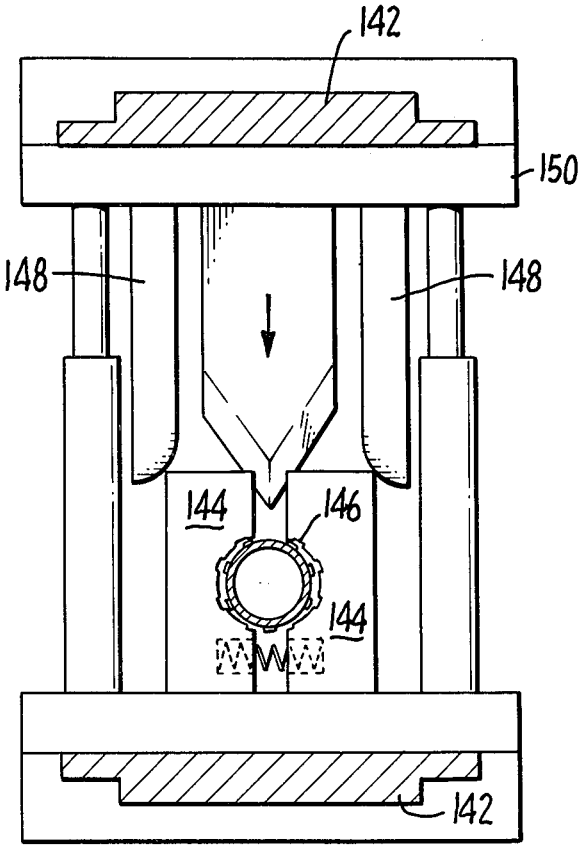
FIG. 21 is a view transverse to the direction of tube travel in the mill, showing the shear for shearing the tube exiting from the mill into sections of predetermined length.

The tubing is cut to desired length by a shear 140 spaced along the pass line from the sizing station 136. The shear 140 is slidably supported for longitudinal movement along the pass line by tracks 142 (See FIG. 21). The slidable mounting is provided in order that the tubing can be sheared without interrputing the continuous travel of the strip. Each tubing section is embraced by clamping blocks 144 which are adapted for inward movement toward the tube to grasp the tube during the shearing operation. The clamping blocks are provided with internal grooves 146 to accommodate the protruding edges $P_1$ in order that these edges are not substantially flattened during the shearing operation. The clamping blocks 144 are moved inwardly by cams 148 which are supported on an upper carriage 150 and operate in unison to simultaneously move both of the clamping blocks. Also supported on the upper carriage is a shear knife 152. In response to timed actuation of the shear 140, the carriage 150 moves downwardly and cams 148 cause the clamping blocks 144 to grip the tubing. When the tubing is gripped, the entire shear moves forward on tracks 142, during which time the shear knife 152 moves downwardly and shears the tube. The sheared tube sections, as may be seen at the left-hand extremity of FIG. 1, are dispensed at the downstream extremity of the mill. Once a tube section is dispensed, the shear 140 moves backward, or to the right as viewed in FIG. 1, for the next shearing operation.

Figure 8:
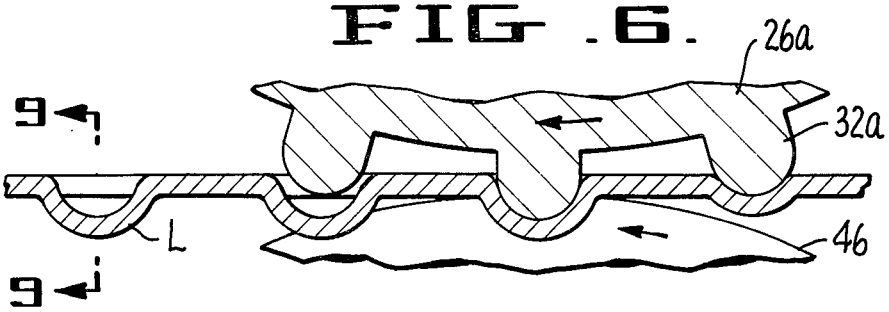
FIG. 8 is an enlarged cross-sectional view of the punch and die rolls of another embodiment of the invention, illustrating a strip of flat roll stock being drawn between the rolls.
Figure 9:
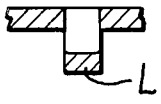
FIG. 9 is a cross-sectional view taken on the plane designated by Line 9—9 of FIG. 8.

FIG. 8 illustrates an alternative punch and die roll arrangement for the roll press. In this alternative embodiment, the punch roll is provided with punch discs **26*a* which are of the same general configuration as the aforedescribed discs 26, with the exception of the punch configuration. In the FIG. 8 embodiment, the punches, designated 32*a*, have a rounded end configuration, as viewed from the side, and sharp lateral edges. As a result, the lateral edges function to cut spaced parallel slit lines in the strip passing through the roll press, while the portion of the strip between the slit lines remains intact and is deformed downwardly to form a loop, designated L. The die roll of the FIG. 8 embodiment is identical to the die roll 20, with the exception that the grooves therein, designated 46*a***, do not have flared edges. As a result, the punched strip formed by the FIG. 8 embodiment does not have laterally flared protruding edges, such as the edges $P_1$.

Another difference between the embodiment of the roll press illustrated in FIG. 8 and the aforedescribed embodiment of FIGS. 4 and 5 is that the FIG. 8 embodiment need not have an ejector mechanism associated with the die roll. The reason that this mechanism is not necessary is that the roll press of the FIG. 8 embodiment does not physically detach segments of metal, such as the segments $S_1$, from the strip being punched.

The tube forming, welding and cutting structure of the mill used with the FIG. 8 embodiment of the roll press may correspond to that described in the foregoing discussion. The principal difference in operation is that the grooves in the various tube-engaging elements of the mill would accommodate passage of the loops L, rather than the protruding edges $P_1$.

Figure 27:
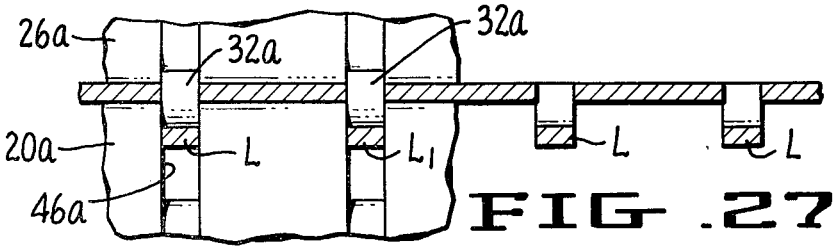

The FIG. 8 embodiment of the roll press and the product formed thereby may also be seen from FIG. 27. FIG. 27 shows that the upper edges of the grooves 46a are of a sharp right angle configuration, as contrasted to the flared configuration $46_1$. The right angled configuration enhances the formation of clean lateral slit lines by the punches 32a. In FIG. 27, the die roll is designated by the numeral 20a.

Figure 23:
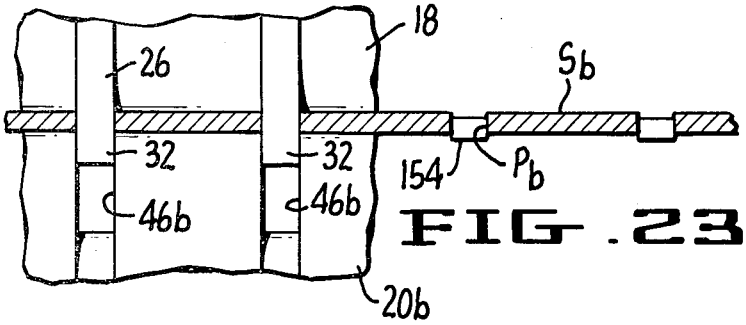
FIG. 23 is a cross-sectional elevational view similar to FIG. 22, illustrating an embodiment of the roll press wherein the rolls are configured so as not to form protruding lateral edges on the perforations being formed.
Figure 24:
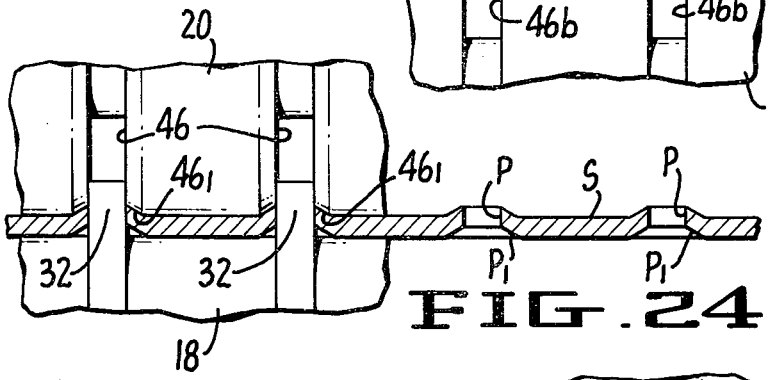
FIG. 24 is a cross-sectional view similar to FIG. 22, illustrating the rolls of an embodiment of the roll press wherein the rolls are configured to form protruding edges extending in a direction opposite to the edges shown in FIG. 22.
Figure 25:
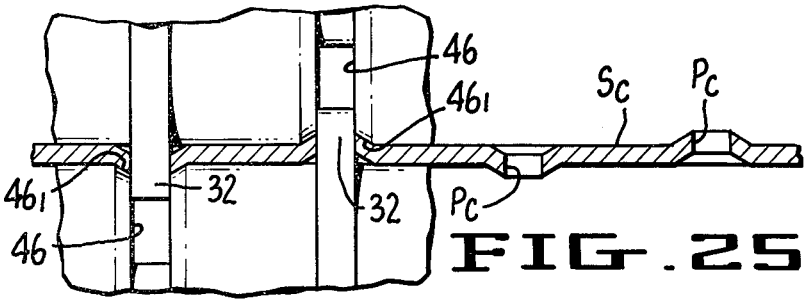
FIG. 25 is a cross-sectional view similar to FIG. 22, illustrating the rolls of an embodiment of the roll press wherein the rolls are conformed to form protruding edges on opposite sides of the rollstock being perforated.

FIGS. 23 to 25, inclusive, illustrate alternative arrangements of the roll press and the punched strip configuration which results from the use of these arrangements. These figures are intended to illustrate that the configuration of the punched strip and, ultimately, the tube formed therefrom may be altered by relatively simple modifications of the punch and die rolls used in the roll press.

Figure 22:
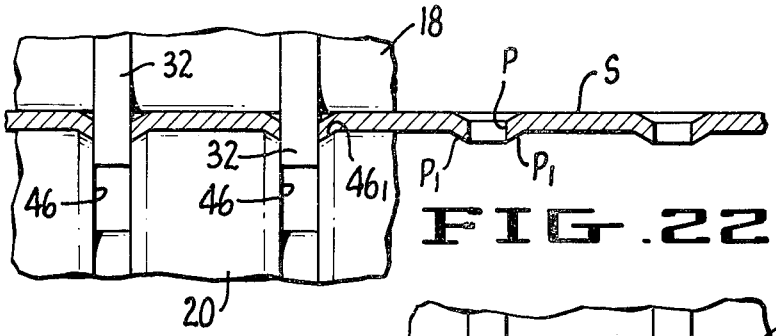
FIG. 22 is a cross-sectional elevational view, with parts thereof broken away, illustrating the rolls of the FIG. 4 embodiment of the roll press of the invention wherein the rolls are configured to form protruding edges on one side of the flat roll stock being perforated.

The roll press configuration of FIG. 23 is designed to provide perforations with relatively flat lateral edges, as contrasted to the protruding edges $P_1$ (Compare FIGS. 22 and 23). This difference is achieved in the FIG. 23 embodiment by simply eliminating the flared edges $46_1$ on the grooves formed in the the die roll. The die roll of the FIG. 23 embodiment is designated by the numeral $20_b$ and the grooves therein are designated $46_b$. The punch roll of the FIG. 23 embodiment is identical to that of the FIGS. 4 and 5 embodiment and, accordingly, it is designated by the numeral 18 and shown as having punch discs 26 with punches 32. The downwardly extending edge formed on the perforations in the strip shown in the FIG. 23 embodiment results from the slight deformation at the leading and trailing edges of the perforations which occurs as the perforations are cut. For purposes of reference, the strip in FIG. 23 is designated $S_b$ and the perforations therein are designated $P_b$. The downwardly extending edges of the perforations $P_b$ are designated 154.

The embodiment depicted in FIG. 24 is identical to that of FIGS. 4, 5 and 22, with the exception that the positions of the punch and die rolls have been reversed. As a result, the protruding edges $P_1$ of the perforations P extend upwardly, as viewed in FIG. 24, rather than downwardly, as viewed in FIG. 22. The reverse arrangement may be employed where it is desired that the protruding edges of the perforations extend inwardly into the tube, rather than outwardly. With the inwardly projecting arrangement of the FIG. 24 embodiment, it is not necessary that the various tube-engaging elements of the mill be provided with grooves to accommodate the protruding edges, since the edges would not be engaged by the elements.

FIG. 25 illustrates an embodiment which, in effect, is a combination of the embodiments of FIGS. 22 and 24. In FIG. 25, the punch discs and mating grooves are alternated so that the protruding edges on adjacent perforations (as viewed transversely of the strip) extend in opposite directions. The punches in the FIG. 25 embodiment are designated by numerals corresponding to those of the embodiment illustrated in FIGS. 4, 5 and 22. The strip in the FIG. 25 embodiment is designated $S_c$ and the perforations therein are designated $P_c$.

It will be appreciated that a tube formed from the perforated strip exiting from the FIG. 25 press would have perforations therein with edges extending both inwardly and outwardly of the tube. The tube-engaging elements of the mill would only need to be grooved to accommodate the outwardly protruding edges.

Figure 26:
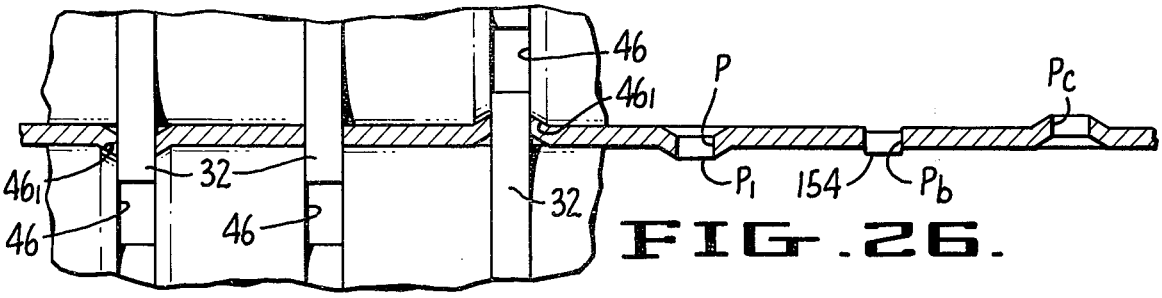
FIG. 26 is a cross-sectional elevational view similar to FIG. 22, illustrating an embodiment wherein the rolls of the roll press are configured to form protruding lateral edges on certain perforations which extend to one side of the roll stock, protruding lateral edges on other perforations which extend to the other side of the roll stock, and lateral edges on yet other perforations which extend to neither side of the roll stock; and, FIG. 27 is a cross-sectional elevational view, with parts thereof broken away, illustrating the rolls of the FIG. 8 embodiment of the roll press wherein the rolls are configured to form perforations with loops extending thereover.

FIG. 26 illustrates a roll press embodiment which, in effect, is a combination of the embodiments of FIGS. 22, 23 and 24. In FIG. 26, the press provides certain perforations with outwardly protruding lateral edges, others with inwardly protruding lateral edges, and still others with flat lateral edges. The various elements in the FIG. 26 embodiment are designated by the same numerals as the corresponding elements in the embodiments of FIGS. 22, 23 and 24. It should be understood that, with the FIG. 26 embodiment, the roll engaging elements of the mill would only need to be grooved to accommodate the outwardly extending protruding edges of the perforations.

Although various arrangements of the roll press and resulting perforated strips have been illustrated in FIGS. 22 to 27, it should be understood that other arrangements might be provided by simply rearranging the manner in which the punch discs and die rings of the roll press are assembled. For example, although not illustrated, it should be understood that loop-forming punches, such as those illustrated in FIG. 27, could be used in combination with punch arrangements such as those illustrated in any one of FIGS. 22, 23, 24, 25 or 26.

Conclusion

In all embodiments of the present invention the roll press is incorporated into the tube mill as the first pass. As a result, the tube formed in the mill has the characteristics imparted to it by the press. The various tube-engaging elements of the mill are designed to accommodate the perforated strip provided by the press and, where the press provides specific protruding configurations, the mill is, ideally, provided with tube-engaging elements which accommodate these protrusions without substantial flattening. Where preservation of protrusions is not desired, however, such accommodation may be omitted, with the result that the protrusions are flattened in the mill. The latter arrangement may be desired where the press forms perforations of the type depicted in FIG. 23 and it is desired that these perforations ultimately have non-protruding edges in the final tube construction.

Although various embodiments have been illustrated and described and alternates of these embodiments have been suggested, it should be understood that the invention is not intended to be so limited, but rather is defined by the accompanying claims.

What is claimed is:

1. A tube mill for directly forming perforated tube from a strip of sheet metal which is fed to the mill in an imperforate condition, said mill comprising: a roll press forming the first pass of the mill and having opposed mating rolls mounted in parallel closely spaced relationship to one another and driven for rotation about the respective longitudinal axes thereof to draw the strip therebetween, one of said rolls having circumferentially continuous annular slots extending therearound and the other of said rolls having punches positioned therearound for entry into the slots of said one roll to perforate the strip as it is drawn between the rolls; a plurality of successive tube forming passes disposed downstream of said roll press to deform the strip exiting from the roll press into a tubular configuration wherein the longitudinal edges of the strip are in confronting relationship to one another; and, a welder disposed downstream of said tube forming passes to weld said confronted edges together.

2. A tube mill, according to claim 1, wherein at least certain of the slots in said one roll have flared edges whereby, upon passage of the punches through a strip being drawn between the rolls, the lateral edges of the perforations formed in the strip by the punches passing into said certain slots are deformed outwardly into the flared edges of the slots to form protruding edges around the perforations.

3. A tube mill, according to claim 2, wherein: the tube forming passes include elements engagable with said surface of the strip to deform the strip into a tubular configuration; and, said elements are grooved to accommodate the protruding edges of the perforations extending from the external peripheral surface of the tube being formed so as to permit the edges to pass through the passes without substantial flattening.

4. A tube mill, according to claim 3, wherein the welder includes elements to embrace the external peripheral surface of strip exiting from the forming passes and said welder elements are grooved to accommodate the protruding edges around the perforations so as not to subject said edges to substantial flattening.

5. A tube mill, according to claim 3, further including a shear disposed downstream of the tube forming passes for shearing tube exiting from the passes into predetermined lengths, said shear having gripper means engagable with the external peripheral surface of the tube and grooved to accommodate the protruding edges around the perforations so as not to subject said edges to substantial flattening.

6. A tube mill, according to claim 1, wherein each punch has a peripherally continuous cutting edge therearound so that passage of the punch through the strip functions to form a perforation by removing material from the strip and wherein the trailing and leading edges of each punch are elongated relative to the lateral edges thereof so as to form end cuts through the strip in advance of formation of lateral cuts through the strip.

7. A tube mill, according to claim 1, wherein at least certain of the punches have a pair of generally parallel cutting edges spaced from one another by non-cutting edges, whereby passage of said punches through the strip functions to cut parallel cut lines through the strip, without removing material therefrom.

8. A tube mill, according to claim 7, wherein: the passage of said certain punches through a strip of sheet metal functions to form loops of metal protruding from one side of said strip; said loops are disposed so as to extend from the external peripheral surface of the tube being formed; the tube forming passes include elements engagable with said surface to deform the strip into a tubular configuration; and said elements are grooved to accommodate the protruding loops to permit the loops to pass through the passes without substantial flattening.

9. A tube mill, according to claim 8, wherein the welder includes elements to embrace the external peripheral surface of the strip exiting from the forming passes and said elements are grooved to accommodate the protruding loops so as not to subject said loops to substantial flattening.

10. A tube mill, according to claim 8, further including a shear disposed downstream of the forming passes for shearing tube exiting from the passes into predetermined lengths, said shear having gripper means engagable with the external peripheral surface of the tube and grooved to accommodate the protruding loops so as not to subject the loops to substantial flattening.

11. A tube mill, according to claim 1, further including an ejector finger extending into each of said slots to eject material which collects therein, said ejector fingers being fixed against rotation with the rolls and so mounted and proportioned as not to interfere with rotaton of the rolls.

12. A tube mill, according to claim 1, wherein the rolls of said roll press each have both circumferentially continuous slots extending therearound and punches positioned therearound, the slots in said one roll being aligned with the punches of said other roll and the slots of said other roll being aligned with the punches of said one roll whereby the punches of the respective rolls pass through opposite sides of a strip drawn therebetween and into the slots aligned with the punches.

13. A tube mill, according to claim 12, wherein at least certain of the slots in said respective rolls have flared edges whereby, upon passage of the punches through a strip being drawn between the rolls, the lateral edges of the perforations formed in the strip by the punches passing into said certain slots are deformed outwardly into the flared edges of the slots to form protruding edges around the perforations.

14. A method for directly forming a perforated tube from a strip of imperforate sheet metal, said method comprising: passing said strip through a roll press having opposed mating rolls mounted in parallel closely spaced relationship to one another and driven for rotation about the respective longitudinal axes thereof to draw the strip therebetween, one of said rolls having circumferentially continuous annular slots extending therearound and the other of said rolls having punches positioned therearound for entry into the slots of said one roll to perforate the strip as it is drawn between the rolls; passing said strip through a plurality of successive tube forming passes disposed downstream of the roll press to deform the strip into a tubular configuration wherein the longitudinal edges of the strip are in confronting relationship to one another; and, passing said strip through a welder disposed downstream of the tube forming passes to weld the confronting edges of the strip together.

15. A method, according to claim 14, wherein at least certain of the slots in said one roll have flared edges whereby, upon passage of punches through the strip and into said certain slots, the lateral edges of the perforations formed in the strip by said punches are deformed outwardly into the flared edges of the slots to form protruding edges around the perforations.

16. A method, according to claim 14, wherein the rolls of said roll press each have both circumferentially continuous slots extending therearound and punches positioned therearound, the slots in said one roll being aligned with the punches of said other roll and the slots of said other roll being aligned with the punches of said one roll whereby the punches of the respective rolls pass through opposite sides of the strip drawn therebetween and into the slots aligned with the punches.

17. A method, according to claim 16, wherein at least certain of the slots in said respective rolls have flared edges whereby, upon passage of the punches through the strip being drawn between the rolls, the lateral edges of the perforations formed in the strip by the punches passing into said certain slots are deformed outwardly into the flared edges of the slots to form protruding edges around the perforations.

18. A method, according to claim 14, wherein at least certain of the punches have a pair of generally parallel cutting edges spaced from one another by non-cutting edges, whereby passage of said punches through the strip functions to cut parallel cut lines through the strip, without removing material therefrom, and to form loops of metal extending from said strip between said cut lines.

* * * * *